United States Patent [19]

Allevato

[11] 4,066,242

[45] Jan. 3, 1978

[54] GARAGE DOOR SPRING STRETCHING DEVICE

[76] Inventor: Louis Allevato, 2928 Sisal Place, Hacienda Heights, Calif. 91745

[21] Appl. No.: 779,275

[22] Filed: Mar. 18, 1977

[51] Int. Cl.[2] ..... B25B 27/00; E05F 1/12

[52] U.S. Cl. ..... 254/10.5; 29/227; 254/78

[58] Field of Search ..... 254/10.5, 78; 29/225, 29/227, 267

[56] References Cited

U.S. PATENT DOCUMENTS 1,467,228 9/1923 Chichy ..... 254/78

3,555,590 9/1968 Halopoff ..... 254/10.5

*Primary Examiner*—Robert C. Watson

*Attorney, Agent, or Firm*—Edgar W. Averill, Jr.

[57] ABSTRACT

A garage door spring stretching device having hook means for attachment to the bracket of a garage door hinge and spring support assembly. The chain is attached to the hook and also to one end of a lever. The lever has a slot in which a slidable hook is held for attachment to the garage door spring. By use of the lever and slidable hook a garage door spring may be stretched and affixed to the garage door bracket assembly.

11 Claims, 13 Drawing Figures

FIG. 5.
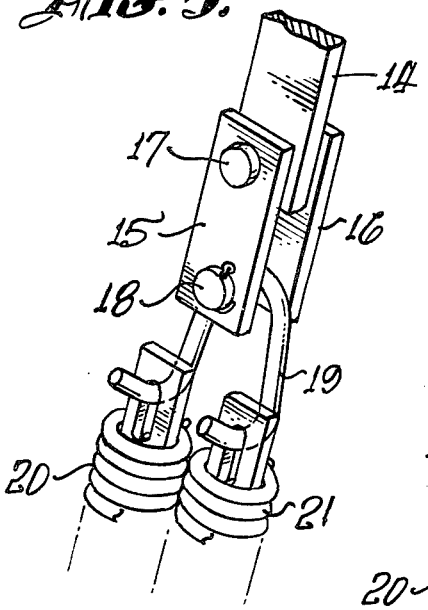
FIG. 6.
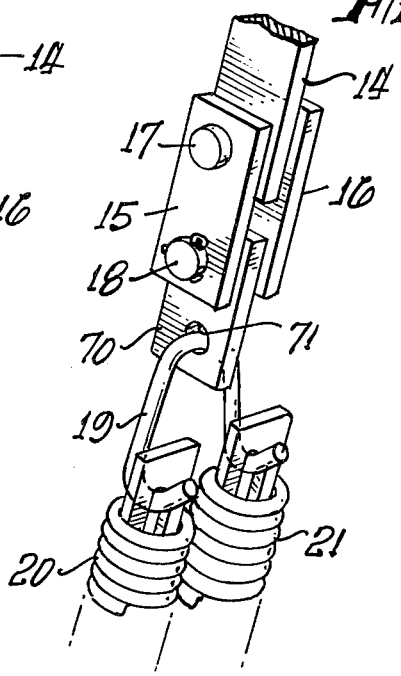
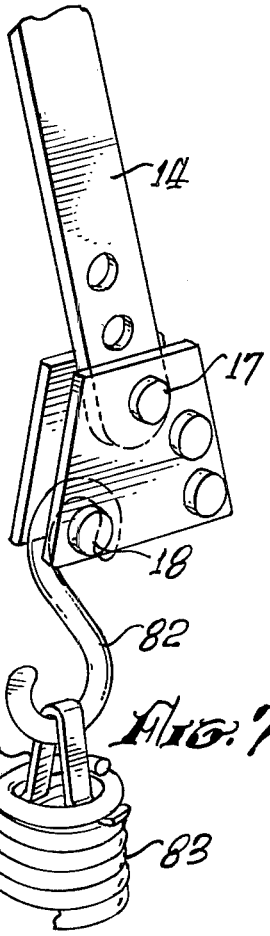
FIG. 7.
FIG. 12.
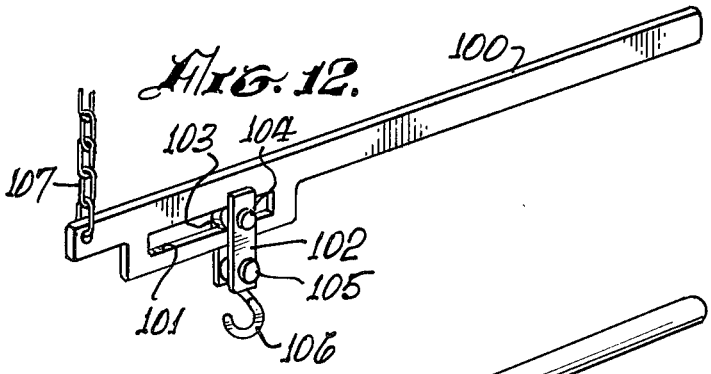
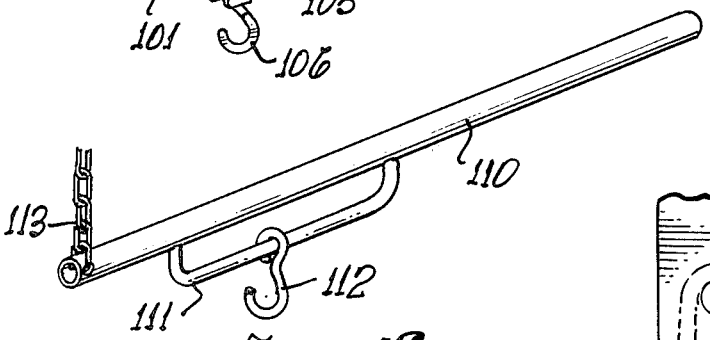
FIG. 13.
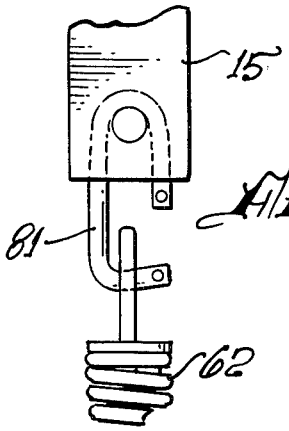
FIG. 8.

FIG. 9.
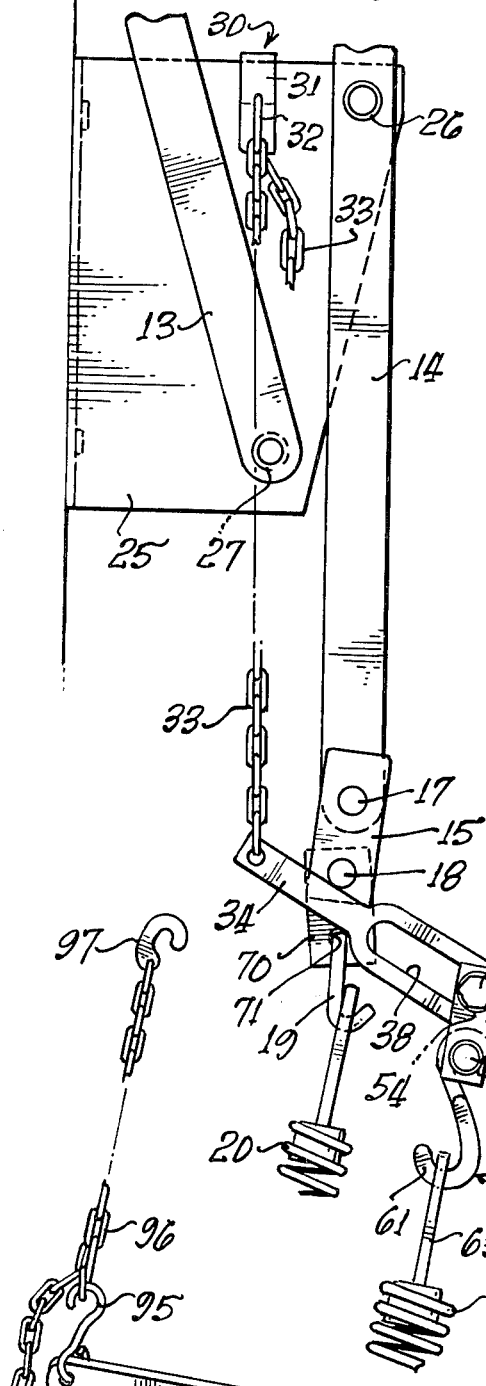
FIG. 10.
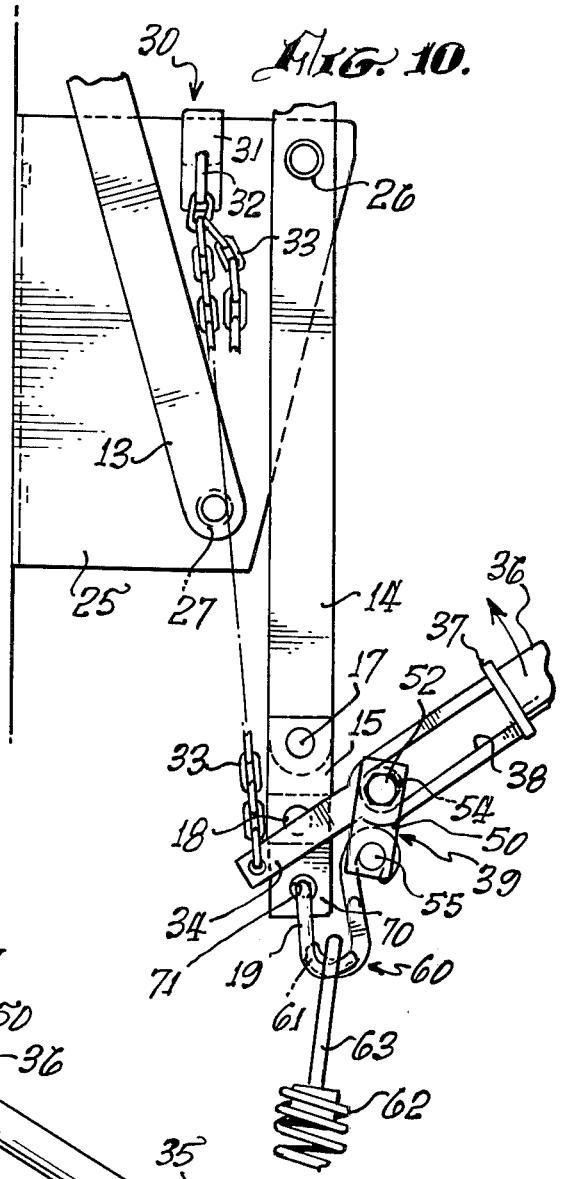
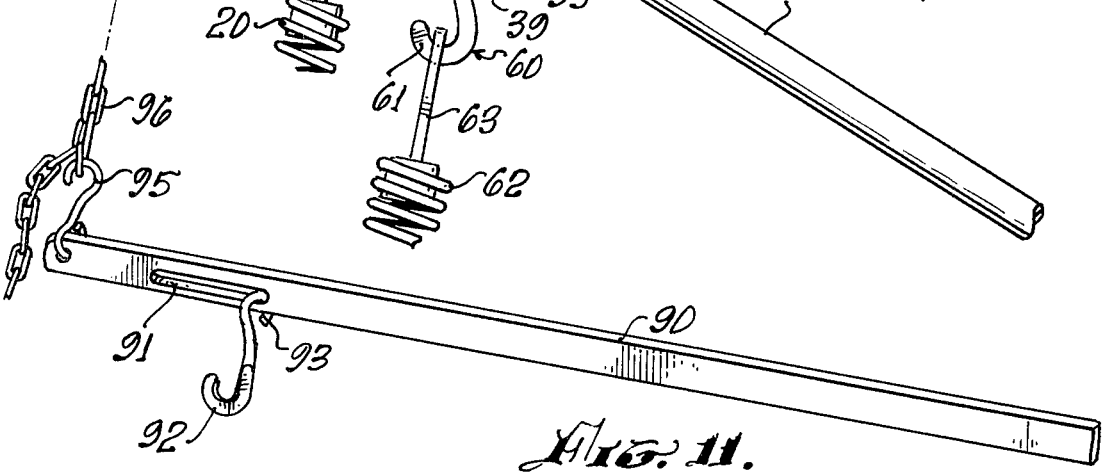
FIG. 11.

GARAGE DOOR SPRING STRETCHING DEVICE

BACKGROUND OF THE DISCLOSURE

Springs are commonly used in conjunction with garage doors to balance the weight of the door and enable the door to be opened with relative ease. Garage door springs generally break after several years of useage and in order to install a new spring the spring must be extended and its end placed over a hook which forms a part of the garage door bracket assembly. The amount of pull required to stretch the spring depends on the spring size but often a pull of as much as 50 lbs. is required and because of the height of the spring it is difficult to exert the required pull in order to stretch the spring over the hook to which it is attached.

SUMMARY OF THE INVENTION

The present invention is for a garage door spring stretching device to assist in the installation of a garage door spring. The spring which is stretched by the device of the present invention is of the type commonly used on garage door support assemblies to help balance the weight of the door and enable it to be opened and closed easily. The support or bracket assembly is affixed to the side of the garage door opening.

The device has hook means which has a bracket-engaging member. The bracket-engaging member has a finger adapted to fit the link of a chain or a loop in a cable. Chain means are affixed to said finger and also affixed to lever means. The lever means has an attachment to which the chain means is affixed and the other end of the lever means forms a handle. Slot means are formed in the lever means near the attachment end thereof. Spring engaging means is slidably held in said slot. Roller means may be positioned in the slot of the lever means to facilitate the lateral movement of the spring engaging means along the lever means. The use of flattened hook as a spring engaging means is particularly useful.

BRIEF DESCRIPTION OF THE DRAWINGS

FIG. 5 is an enlarged, fragmentary perspective view of the spring hook of the bracket of FIG. 1.

FIG. 6 is a perspective view of an alternate embodiment of the spring hook of FIG. 5.

FIG. 7 is an enlarged, fragmentary perspective view of an alternate spring hook of the bracket of FIG. 1.

FIG. 8 is an enlarged, fragmentary side elevation of an alternate type of spring hook useful with the garage door bracket of the general type shown in FIG. 1.

FIG. 9 is an enlarged side elevation, partly broken away, of the garage door bracket assembly of FIG. 1 modified as shown in FIG. 6 and the garage door spring stretching device of FIG. 2.

FIG. 10 is a duplicate of FIG. 4 except that the spring stretching device has been lifted to a spring engaging position.

FIG. 11 is a perspective view of a modified form of the spring stretching device of FIG. 2.

FIG. 12 is a perspective view of a modified form of the spring stretching device of FIG. 2.

FIG. 13 is a perspective view of a modified form of the spring stretching device of FIG. 2.

DESCRIPTION OF THE PREFERRED EMBODIMENTS

Figures 1, 2, 3, 4:
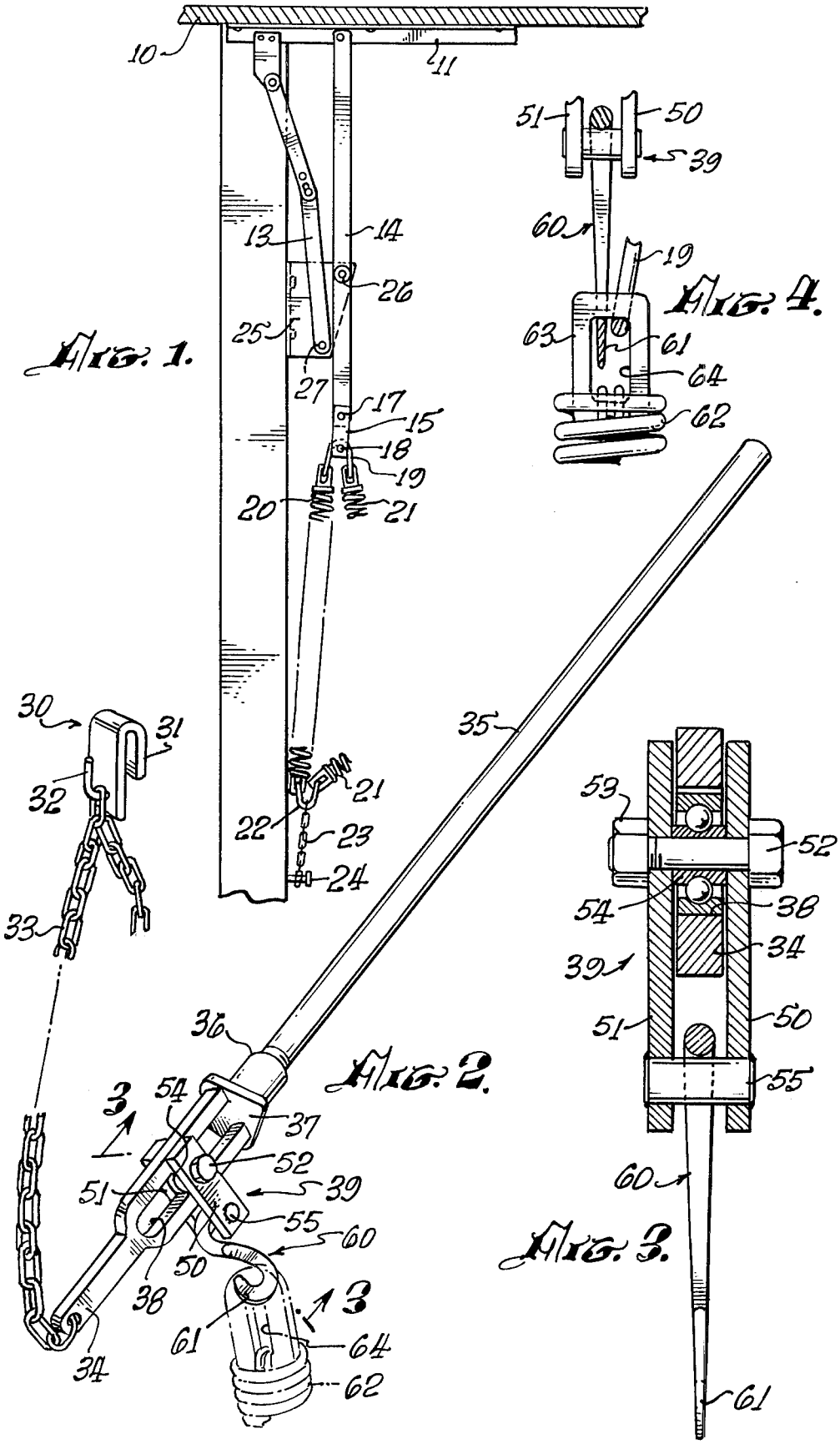
FIG. 1 is a side elevation of a portion of a garage door, a garage door bracket assembly having one broken spring and one unbroken spring.
FIG. 2 is a perspective view of the garage door spring stretching device of the present invention attached to the upper end of a spring.
FIG. 3 is an enlarged cross sectional view taken along line 3—3 of FIG. 2.
FIG. 4 is a view analagous enlarged to FIG. 3 with the addition of a spring supporting hook of the bracket assembly of FIG. 1.

As shown in FIG. 1, a garage door 10 is bolted to a length of angle iron 11 which is supported to the garage door frame 12 by a pair of arms 13 and 14. Arm 13 provides pivotal support and arm 14 transmits the energy stored in the springs to balance the door during opening and closing. Arm 14 will be referred to herein as the spring support arm and a pair of plates 15 and 16 (plate 16 does not show since it is directly behind plate 15) are held to arm 14 by pin 17. A second pin 18 supports a "W" hook 19 which in turn supports a pair of springs 20 and 21. Many garage door support assemblies use one spring in place of two and the use of the device of the present invention on such doors is discussed below with respect to FIG. 7. Spring 21 is broken and a new spring must be stretched for attachment to "W" hook 19. Springs 20 and 21 are attached to a second "W" hook 22 which is affixed by chain 23 and bolt 24 to frame 12.

The door and springs are held to frame 12 by a bracket 25 which supports a bearing 26 affixed to arm 14 and a bearing 27 affixed at the end of arm 13.

The spring stretching device of the present invention is shown in perspective view in FIG. 2. Hook means are indicated generally by reference character 30 and have a bracket-engaging member 31 and a finger 32 welded to the bracket-engaging member. A chain 33 has one link hooked over finger 32 and is attached at its other end to one end of a lever 34. Additional links are available in chain 33 so that the position of lever 34 may be lowered if desired. The other end of lever 34 comprises a handle 35. Handle 35 is threaded onto a coupling 36 which is welded to a plate 37. A slot 38 is formed in lever 34 and also welded to plate 37. The use of coupling 36, plate 37 and its welding to lever 34 is merely one way of affixing a slotted lever to a handle. Alternate devices are shown in FIGS. 11, 12 and 13 and discussed below.

The spring engaging means is indicated generally by reference character 39 and is shown in enlarged cross sectional view in FIG. 3. Spring engaging means 39 has a pair of plates 50 and 51 held together by a bolt 52 which is tightened by nut 53 onto bearing 54. The outer race of bearing 54 rides in slot 38 and bearing 54 facilitates the sliding of the spring engaging means along the slot 38. Other bearing means may be used in place of bearing 54.

A pin 55 is held by plates 50 and 51. Pin 55 supports a hook 60 which has a flattened end 61. Hook 60 is placed through the upper loop of the replacement spring in a manner described below.

The type of dual spring garage door bracket assembly shown in FIG. 1 frequently utilizes a pair of "W" hooks positioned so that the two springs are in a plain parallel to the plain of bracket 25. In order to facilitate the use of the device of the present invention an additional plate 70 is placed over pin 18 which is typically readily removed by a removal of a cotter pin on the side of the pin which extends through plate 16. "W" hook 19 is then inserted through a hole 71 is plate 70. Springs 20 and 21 then are placed in a plain perpendicular to the plain of bracket 25.

In order to install a new spring 62, hook 60 is inserted through the hole in plate 63 which is welded to the upper end of new spring 62. Plate 63 is shown more clearly in FIG. 4. The lower end of spring 62 has been affixed to "W" hook 22. After insertion of hook 60 into the hole of plate 63, chain 33 is hooked over finger 31 of hook means 30. The bracket engaging member 31 of hook means 30 is placed over the upper edge of bracket 25 so that bearing 54 is held at the lower end of slot 38.

As shown in FIG. 10 as handle 35 is raised, spring 62 is stretched and when slot 38 is about horizontal, hook 60 can be readily moved lateterly along lever 34 so that the opening in plate 63 passes over "W" hook 19. After this, the lever arm may be lowered and hook 60 may be removed from the opening in plate 63 and the new spring is installed.

As stated above, hook 60 preferably has a flattened end 61. This flattened end permits the easy removal of hook 60 from the opening 70 in plate 63. As shown in FIG. 4, "W" hook 19 and flattened end 61 may be held side by side in opening 70.

There are several alternative types of hooks from that shown in FIGS. 1, 9 and 10. Two commonly used hooks are shown in FIGS. 7 and 8. A "C" hook 81 is shown in FIG. 8. Such hook is typically used in conjunction with an "L" plate which is not shown as it is not a portion of the present invention. A "S" hook 82 is shown in FIG. 9. Such hooks as "C" hook 81 and "S" hook 82 are commonly used with door support assemblies having a single spring, such as spring 83 of FIG. 7. Spring 83 has a support loop 84 which will readily accept hook 60.

A modified form of the device of the present invention is shown in FIG. 11 where lever arm 90 is formed from a bar of steel. A slot 91 is formed in lever arm 90 and a hook 92 has a looped end 93 which holds hook 92 in slot 91. As with hook 60, hook 92 may have a flattened end. A second hook 95 is held at the end of lever arm 90. Hook 95 passes through a link in chain 96 which is affixed at its upper end to bracket engaging member 97. Member 97 has a hold formed therethrough for permanent attachment of the chain. It can thus be seen that the chain may be affixed either at the bracket engaging member or at the lever arm and hooked on the member to which it is not affixed. Also, it can be seen that a bearing assembly is not essential for the practice of the present invention although it does facilitate the movement of the hook in the slot of the lever arm.

Another modified form of the spring stretching device of the present invention is shown in FIG. 12 where lever arm 100 is formed from a plate of steel having a slot 101 formed therein. A pair of plates 102 and 103 support a pin 104 which travels along slot 101. A second pin 105 supports hook 106 which operates in a manner analagous to the hook 60 of the device shown in FIG. 2. Similarly a chain 107 operates in manner identical to chain 33 of the device shown in FIG. 2.

A still further alternative device is shown in FIG. 13. Pipe 110 has a rod 111 affixed thereto and a hook 112 rides along rod 111. A chain 113 is held in an opening in the end of pipe 110.

Other spring engaging members rather than the flattened hook may also be used in the practice of the present invention. A flexible cable having a small hook wedged thereto could alternatively be used. The important features are that the hook means be attachable to the end of the spring in a manner which permits its removal after the spring has been inserted over the hook which is affixed to the spring support arm 14. Because of the various types of spring openings, the particular design of hook will be dependent upon the type spring with which is intended to be used. Many springs simply have a loop formed from the spring wire and such a loop may be readily held by a hook such as that shown in the present drawings or by a "S" hook similar to that shown in FIG. 7 and indicated by reference character 82. Therefore, the words "spring engaging means" is intended broadly to refer to the member which attaches to the spring and is slidably affixed to the lever arm of the device of the present invention.

The present embodiments of this invention are thus to be considered in all respects as illustrative and not restrictive, the scope of the invention being indicated by the appended claims rather than by the foregoing description. All changes which come within the meaning and range of equivalency of the claims therefore are intended to be embraced therein.

I claim:

1. A garage door spring stretching device for assisting in the installation of a garage door spring of the type useful on garage door support assemblies having a bracket affixed to the side frame of the garage opening, said device comprising:

hook means having a bracket engaging member, said bracket engaging member having means adapted to fit a chain means;

chain means affixed to said bracket engaging member;

lever means having an attachment end and a handle end, said lever means being connected to said chain means at said attachment end;

slot means located in said lever means near the attachment end thereof; and spring engaging means slidably held in said slot means.

2. The device of claim 1 wherein said chain means is a link chain.

3. The device of claim 2 wherein said means adapted to fit chain means comprises a finger affixed to said bracket engaging member.

4. The device of claim 1 wherein said means adapted to fit chain means comprises a hook affixed to the attachment end of said lever means.

5. The device of claim 1 wherein said lever means is a bar having an enlongated slot formed near the attachment end thereof.

6. The device of claim 1 wherein said spring engaging means has roller means held in said slot means to facilitate movement of said spring engaging means along said lever means.

7. The device of claim 6 wherein said spring engaging means is a hook held in a bracket affixed to said roller means.

8. The device of claim 1 wherein said spring engaging means has a flattened hook removably engageable with the end of a garage door spring.

9. The device of claim 1 wherein said lever means is formed from a plate with an enlarged width portion having a slot formed therein.

10. The device of claim 1 wherein said lever means is formed from a pipe having a rod affixed thereto, said rod being affixed in a parallel position to said pipe near the attachment end thereof.

11. The device of claim 10 wherein said spring engaging means comprises a hook having a looped end formed around said rod.

* * * * *